US005338230A

United States Patent [19]

Bryce et al.

[11] Patent Number: 5,338,230

[45] Date of Patent: Aug. 16, 1994

[54] ELECTRICAL CONNECTOR ASSEMBLY

[75] Inventors: Brian Bryce, Corbally; Mathew Wilhite, Dooravoyle, both of Ireland

[73] Assignee: Molex Incorporated, Lisle, Ill.

[21] Appl. No.: 84,396

[22] Filed: Jun. 29, 1993

[51] Int. Cl.[5] ..... H01R 23/70

[52] U.S. Cl. ..... 439/629

[58] Field of Search ..... 439/629–637

[56] References Cited

U.S. PATENT DOCUMENTS

| | | | |
|---|---|---|---|
| 4,356,532 | 10/1982 | Donaher et al. | 439/629 |
| 4,501,465 | 2/1985 | Hoshino et al. | 439/633 |
| 5,035,631 | 7/1991 | Piorunneck et al. | 439/630 |
| 5,052,943 | 10/1991 | Davis | 439/357 |
| 5,158,468 | 10/1992 | Curtis et al. | 439/76 |
| 5,203,725 | 4/1993 | Brunker et al. | 439/636 |
| 5,207,598 | 5/1993 | Yamada et al. | 439/636 |

*Primary Examiner*—Steven C. Bishop
*Attorney, Agent, or Firm*—Stephen Z. Weiss

[57] ABSTRACT

An electrical connector assembly is disclosed for connecting a mating connector to a printed circuit board. The assembly includes a dielectric housing having a plurality of terminal-receiving cavities and a plurality of terminals insertable into the cavities. Each terminal includes a base section insertable into a respective cavity in an insertion direction for securing the terminal in the cavity. The terminal includes a tail section for contacting the printed circuit board and spring contact beam for electrically engaging a conductor of the mating connector. The tail section and the spring contact beam extend from the base section and are spaced apart transverse to the insertion direction, whereby an insertion tool can be inserted therebetween into engagement with the base section to readily force the terminal into its terminal-receiving cavity.

10 Claims, 3 Drawing Sheets

ELECTRICAL CONNECTOR ASSEMBLY

FIELD OF THE INVENTION

This invention generally relates to the art of electrical connectors and, particularly, to an electrical connector assembly which includes a unique terminal construction for facilitating insertion of the terminal into a connector housing.

BACKGROUND OF THE INVENTION

Various electrical connector assemblies include terminals which have base sections for securing the terminals in a dielectric housing of the connector assembly. Other portions of the terminals, such as contact means, solder tails, spring contact arms, etc. project from the rigidly secured base sections of the terminals. Such a terminal may be fabricated as a stamped and formed sheet metal component, with the base section of the terminal being forced into a cavity in the dielectric housing. The base section may include barbs along opposite edges thereof for skiving into the material of the housing to rigidly secure the terminal in its cavity.

For instance, these types of terminals are used in recharging and data retrieval apparatus, such as a portable telephone. A hand held phone set is positionable into and removed from a cradle formed by a base unit. The hand held phone set has exposed contact means, and the base unit often has a plurality of spring contact arms exposed thereon for engaging the contact means of the hand held phone set, such as for recharging the batteries thereof. The terminals of the base unit include base sections insertable into cavities in a dielectric housing to secure the terminals thereon, with the spring contact arms projecting from the base sections for engaging the contact means of the hand held phone set. The terminals also may include solder tails for engaging circuit traces on a circuit board within the base unit.

One of the problems with such electrical connector apparatus involves mounting or inserting the terminals into their respective cavities. Insertion tools often are used for inserting the terminals into their cavities, and the insertion forces must be transmitted to the base sections of the terminals which are rigidly secured to the housing. With the spring contact arm and the tail section of a given terminal projecting from the base section thereof, heretofore there has been no area left for an insertion tool to directly engage the base section. Obviously, the spring contact arm is too flexible for receiving insertion forces. When insertion forces are applied by a tool to the tail section of the terminal, too small a surface area often is provided, and either the tail section or other portions of the terminal tend to twist or deform when being inserted.

This invention is directed to solving the problems outlined above and providing a terminal construction of the character described, wherein an insertion tool can directly engage the base section of the terminal to force the base section into its respective mounting cavity in the connector housing.

SUMMARY OF THE INVENTION

An object, therefore, of the invention is to provide an electrical connector assembly with a new and improved terminal construction for facilitating insertion of the terminal into a cavity in the connector housing.

In the exemplary embodiment of the invention, the electrical connector assembly is designed for connecting a mating connector to a printed circuit board. The assembly includes a dielectric housing having a plurality of terminal-receiving cavities and a plurality of terminals insertable into the cavities. Each terminal includes a base section insertable into a respective cavity in an insertion direction and having mounting means for securing the terminal in the cavity. The terminal includes contact means for contacting the printed circuit board and spring arm means for electrically engaging a conductor of the mating connector. The contact means and the spring arm means extend from the base section.

The invention contemplates an improvement wherein the contact means and the spring arm means are offset on opposite sides of a line passing through a mid-point of the base section in the insertion direction. This allows access to the base section, between the contact means and the spring arm means, for an insertion tool to force the terminal into its respective terminal-receiving cavity.

As disclosed herein, the contact means of the terminal is provided by a solder tail section projecting from the base section, and the spring arm means is provided by a spring contact beam projecting from the base section. The spring contact beam projects from the base section in the same direction as the solder tail section, and the beam is bent back in an opposite direction over the base section.

Another feature of the invention is the provision of a distal end of the spring contact beam being adapted for engaging a shoulder of the connector housing to preload the spring contact beam. In the preferred embodiment of the invention, each terminal is provided as a stamped and formed sheet metal component.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
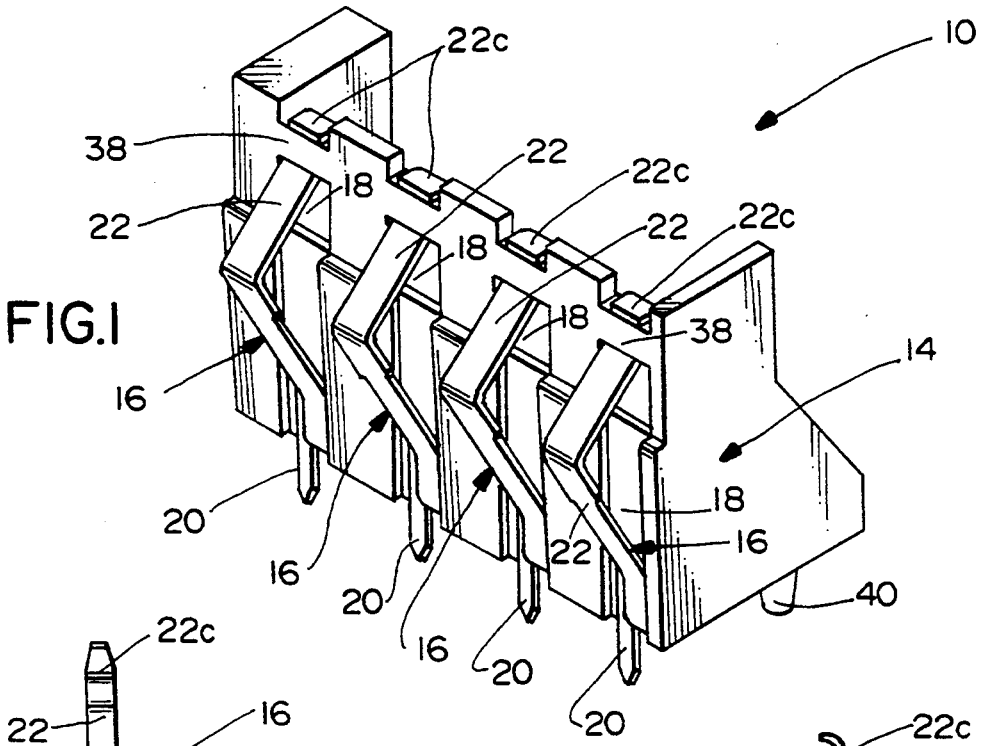
FIG. 1 is a perspective view of an electrical connector assembly embodying the concepts of the invention.
Figure 2:
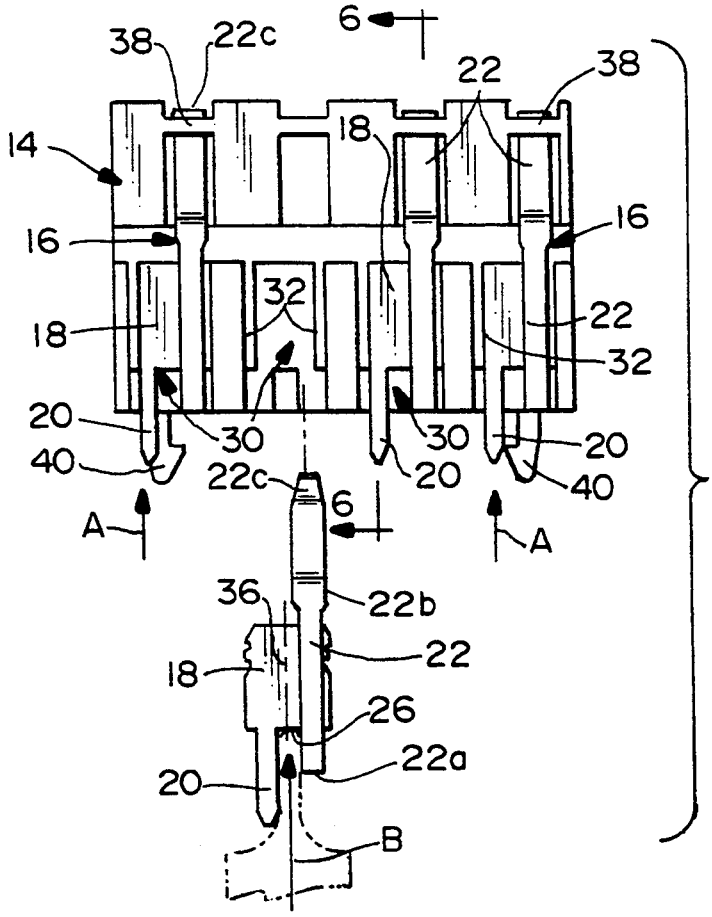
FIG. 2 is a front elevational view of the connector assembly, with one of the terminals removed from the housing to facilitate the illustration.
Figure 7:
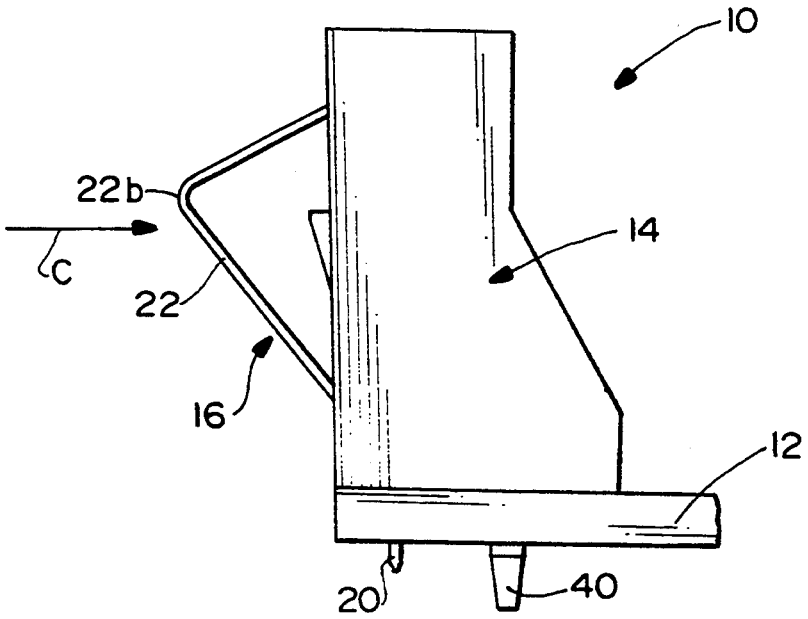
FIG. 7 is a side elevational view of the connector assembly mounted to a printed circuit board.

Referring to the drawings in greater detail, and first to FIGS. 1 and 2, the invention is embodied in an electrical connector assembly, generally designated 10, for connecting a mating connector (not shown) to a printed circuit board 12 (FIG. 7). Connector assembly 10 includes a dielectric housing, generally designated 14, for mounting a plurality of terminals, generally designated 16. As will be described in greater detail hereinafter, terminals 16 are mounted on housing 14 by insertion of the terminals into respective terminal-receiving cavities in the housing.

Figure 3:
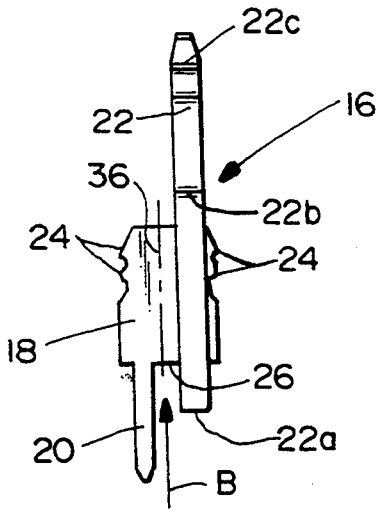
FIG. 3 is a front elevational view of one of the terminals of the connector assembly.
Figure 4:
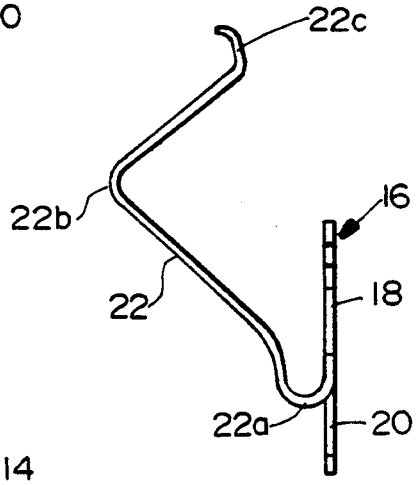
FIG. 4 is a side elevational view of the terminal.

Turning next to FIGS. 3 and 4, each terminal 16 includes a base section 18, contact means in the form of a tail section 20 and spring arm means in the form of a spring contact beam 22. Each terminal 16 preferably is stamped and formed from sheet metal material. Therefore, base section 18 is generally planar and includes one or more barbs 24 formed on opposite edges thereof. Dielectric housing 14 may be unitarily molded of plastic material or the like, and barbs 24 will skive into the plastic material bounding the terminal-receiving cavities. Therefore, base section 18, with or without barbs 24, comprise mounting means for securing the terminal in its respective cavity in housing 14.

Tail section 20 of each terminal 16 is adapted for insertion into an appropriate hole in printed circuit board 12 (FIG. 7). The tail section may be soldered to circuit traces on the board or in the hole. The tail section may be plated with an appropriate solder-enhancing material, a conduction enhancing material or the like. It can be seen that tail section 20 projects from an edge 26 of base section 18.

Spring contact beam 22 also projects from edge 26 of base section 18 and is bent back, as at *22a*, over the base section to define an outwardly projecting elbow *22b* which actually forms a contact section of the spring contact beam. The elbow is the area of the spring contact beam which will engage a contact on the mating connector. Lastly, a distal end *22c* of spring contact beam 22 is bent into a hooked configuration for latching under a shoulder of housing 14 for preloading the contact beam, as will be described hereinafter.

Figure 5:
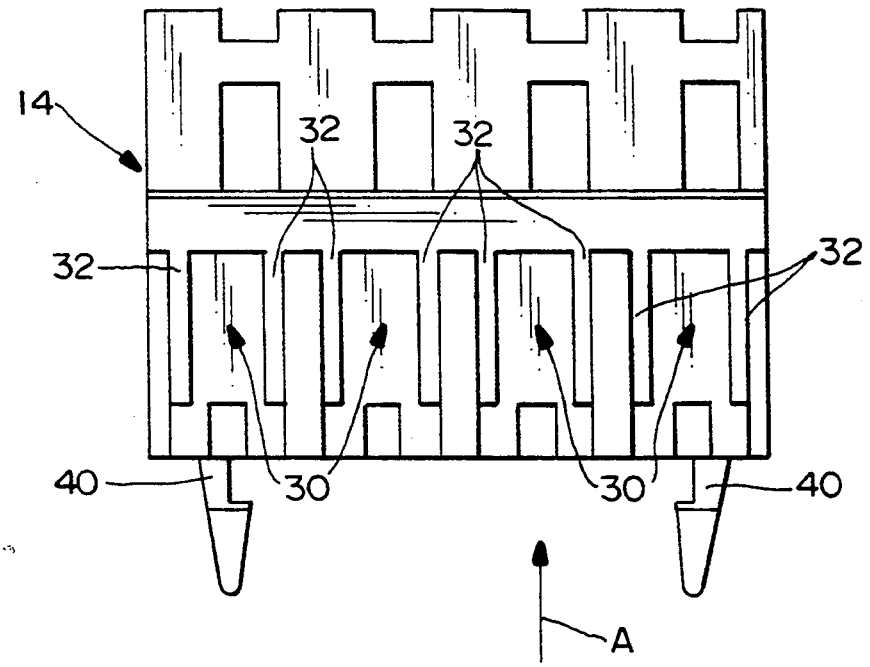
FIG. 5 is a front elevational view of the dielectric housing of the connector assembly.

Turning next to FIG. 5, housing 14 includes a plurality of terminal-receiving cavities, indicated generally at 30, for receiving respective ones of terminals 16. It can be seen in FIG. 5 that each cavity is, in part, defined by a pair of opposing or inwardly directed ledges 32 behind which opposite barbed edges of base sections 18 of terminals 16 are inserted in the direction of arrows "A" (FIG. 5). FIG. 2 shows three terminals 16 inserted into their respective cavities in the direction of arrows "A", with one terminal about to be inserted. When fully inserted, base section 18 of the terminals are securely captured within their cavities.

As seen in FIG. 2 and particularly in FIG. 3, tail section 20 and spring contact beam 22 are offset on opposite sides of a line 36 which passes through a transverse mid-point of base section 18 between the tail section and the spring contact beam. In other words, the tail section and the spring contact beam are spaced apart transverse to the insertion direction of the terminal as described above by arrows "A" in FIGS. 2 and 5. Referring particularly to FIG. 3, this transverse spacing of tail section 20 and spring contact beam 22 leaves a portion of edge 26 of base section 18 exposed for engagement by an insertion tool in the direction of arrow "B" (FIGS. 2 and 3). Therefore, the insertion tool can directly engage the base section and force the base section into its respective terminal-receiving cavity 30 behind ledges 32. The much smaller and delicate contacting portions of the terminal, namely tail section 20 and spring contact beam 22 are not exposed to any of the insertion forces as often times occurred with the prior art.

Figure 6:
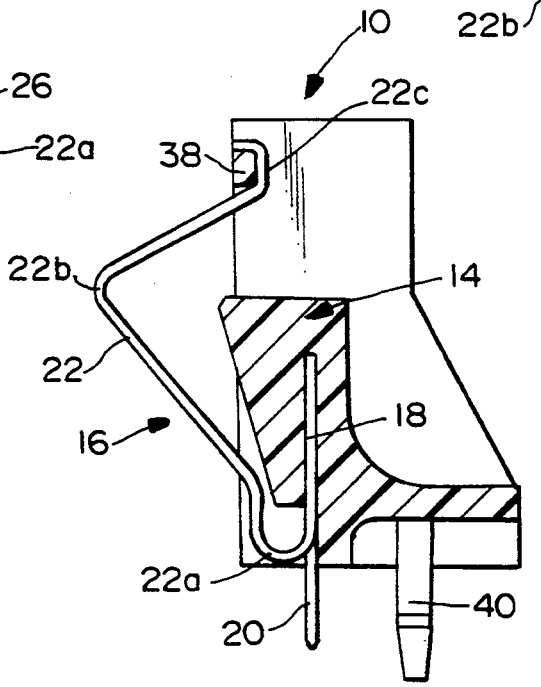
FIG. 6 is a section taken generally along line 6—6 of FIG. 2, but with the terminal in elevation.

FIG. 6 shows a feature of the invention wherein hooked distal end *22c* of spring contact beam 22 of each terminal 16 is moved behind a shoulder 38 of dielectric housing 14, after the terminal is inserted into its respective cavity. In essence, the spring contact beam is biased from its unstressed condition shown in FIG. 4 to its preloaded condition shown in FIG. 6.

Lastly, referring to FIG. 7, electrical connector assembly 10 is shown mounted to printed circuit board 12, with tail sections 20 of terminals 16 projecting through the board. Dielectric housing 14 also includes a pair of mounting pegs 40 which are insertable into appropriate mounting holes in the board. It can be seen how spring contact beams 22 of the terminals project outwardly from dielectric housing 14 of the connector assembly, with contact sections *22b* exposed for engaging the contact means of a mating connector which is mated in the direction of arrow "C". For instance, connector assembly 10 may be a battery connector of a base unit, with contact sections *22b* of spring contact beams 22 engageable by contact means of a portable hand set.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for connecting a mating connector to a printed circuit board, the assembly including a dielectric housing having a plurality of terminal-receiving cavities extending into the housing from a surface of the housing and a plurality of terminals insertable into the cavities, each terminal including a base section insertable into a respective cavity in a base insertion direction defined as a direction from said housing surface into said housing for securing the terminal in the cavity, contact means for contacting the printed circuit board and spring arm means for electrically engaging a conductor of the mating connector, the contact means and the spring arm means extending from the base section, wherein the improvement comprises said contact means and said spring arm means both projecting from the base section in a direction opposite said base insertion direction and being offset on opposite sides of a line passing through a mid-point of the base section in said base insertion direction to allow access to the base section between the contact means and the spring arm means for an insertion tool to force the terminal into its respective terminal-receiving cavity.

2. In an electrical connector assembly as set forth in claim 1, wherein said contact means comprise a solder tail section projecting from the base section.

3. In an electrical connector assembly as set forth in claim 2, wherein said spring arm means comprise a spring contact beam projecting from the base section.

4. In an electrical connector assembly as set forth in claim 3, wherein said spring contact beam being bent back in the base insertion direction over the base section.

5. In an electrical connector assembly as set forth in claim 4, wherein said spring contact beam includes a distal end adapted for engaging a shoulder of the housing to preload the spring contact beam.

6. In an electrical connector assembly as set forth in claim 5, wherein each terminal comprises a stamped and formed sheet metal component.

7. In an electrical connector which includes a dielectric housing having a plurality of terminal-receiving cavities extending into said housing from a surface of the housing and a plurality of terminals insertable into the cavities, each terminal including a base section insertable into a respective cavity in a base insertion direction defined as a direction from said housing surface into said housing for securing the terminal in the cavity, a contact means extending from the base section and a spring arm means extending from the base section, wherein the improvement comprises said contact means and said spring arm means both projecting from the base section in a direction opposite said base insertion direction and being spaced apart transverse to said base insertion direction whereby an insertion tool can be inserted therebetween into engagement with the base section to readily force the terminal into its terminal-receiving cavity.

8. In an electrical connector assembly as set forth in claim 7, wherein said spring arm means being bent back in the base insertion direction over the base section.

9. In an electrical connector assembly as set forth in claim 8, wherein said spring arm means includes a distal end adapted for engaging a shoulder of the housing to preload the spring arm means.

10. In an electrical connector assembly as set forth in claim 9, wherein each terminal comprises a stamped and formed sheet metal component.

* * * * *